United States Patent [19]

Kristofferson et al.

[11] Patent Number: 4,726,919

[45] Date of Patent: Feb. 23, 1988

[54] METHOD OF PREPARING A NON-FEATHERING NITRAMINE PROPELLANT

[75] Inventors: Clifford E. Kristofferson, North Ogden; Donald G. Fisher, Tremonton; Frank H. Bell, Logan, all of Utah

[73] Assignee: Morton Thiokol, Inc., Chicago, Ill.

[21] Appl. No.: 748,922

[22] Filed: Jun. 26, 1985

Related U.S. Application Data

[63] Continuation-in-part of Ser. No. 731,440, May 6, 1985, abandoned.

[51] Int. Cl.[4] ..... C06B 45/10

[52] U.S. Cl. ..... 264/33; 149/19.4; 149/19.92

[58] Field of Search ..... 264/3.3; 149/19.92, 149/19.4

[56] References Cited

U.S. PATENT DOCUMENTS

| | | | |
|---|---|---|---|
| 3,888,707 | 6/1975 | Rothenstein | 149/19.4 |
| 3,943,209 | 3/1976 | LoPresti et al. | 264/3.3 |
| 4,002,514 | 1/1977 | Plomer et al. | 149/19.4 |
| 4,091,729 | 5/1978 | Bell et al. | 149/19.4 |
| 4,263,070 | 4/1981 | Price et al. | 149/19.4 |
| 4,405,534 | 9/1983 | Diesenroth | 149/19.92 |
| 4,456,493 | 6/1984 | Barnes et al. | 149/19.4 |
| 4,462,848 | 7/1984 | Elrick | 149/19.92 |
| 4,650,617 | 3/1987 | Kristofferson et al. | 264/3.3 |

*Primary Examiner*—Edward A. Miller
*Attorney, Agent, or Firm*—Gerald K. White

[57] ABSTRACT

A low vulnerability ammunition (LOVA) propellant is prepared with a polyurethane binder and a mixture of nitramines consisting essentially of RDX and at least 7.5 wt. % HMX (based on combined oxidizer binder matrix weight). Dilution of RDX with HMX enhances precure extrudability of the propellant grain. Polymerization and extrudability is provided without slumping prior to total cure given a NCO:DIOL:TRIOL equivalent ratio of from about 110:15:85.

6 Claims, No Drawings

METHOD OF PREPARING A NON-FEATHERING NITRAMINE PROPELLANT

BACKGROUND OF THE INVENTION

The United States Government has a paid-up license in this invention and the right in limited circumstances to require the patent owner to license others on reasonable terms as provided for by the terms of contract No. DAAD05-76-C0758 awarded by The Department of The Army.

CROSS REFERENCE TO RELATED APPLICATIONS

This application is a continuation-in-part application of copending application Ser. No. 731,440, filed May 6, 1985, entitled "Solid Composite Bi-Nitramine Propellent and Method of Making Same", and now abandoned.

This application is related in subject matter to concurrently filed application Ser. No. 748,889, invented by Clifford E. Kristofferson, Donald G. Fisher, Frank H. Bell, and William Wagner and entitled "Solvent-Free Preparation of Gun Propellant Formulations".

FIELD OF THE INVENTION

This invention relates to proellants containing nitramine oxidizers. More particularly, this invention relates to HMX/RDX oxidizer mixtures utilized in propellants for guns, artillery, tank cannon, and the like.

DESCRIPTION OF THE RELEVANT ART

Gun propellants for ammunition with a low vulnerability to heat, flame, impact and chemical action (LOVA propellants) are important in confined quarters, such as tanks, submarines, or other armored vehicles. These propellants typically contain a resin binder system and an oxidizer. The utilization of either HMX or RDX as a LOVA oxidizer is known.

HMX is also known as cyclotetramethylenetetranitriamine. RDX is also known as cyclotrimethylinetrinitramine.

It is also known now to produce an extrudable HMX-resin binder mixture. The extruded material may be cut into small segments and cured to provide a suitable propellant for artillery and other LOVA projectiles. Generally, however, RDX cannot be utilized in the same fashion as HMX-containing mixtures because RDX is dilatant. That is, when RDX is suspended in a resin binder system, the resistance to flow of that mixture increases at a greater rate than the increase in the rate of flow of the mixture. As a consequence, applicants have found that on the order of 2000 psia or greater are required to extrude propellants containing only RDX as an oxidizer.

Furthermore, applicants have discovered that when only RDX is used as the oxidizer, the finished extruded propellent grains have feathered surfaces rather than smooth surfaces. This feathering is undesirable as it leads to unpredicatable burn characteristics.

SUMMARY OF THE INVENTION

This invention includes suitable parameters for diluting RDX and HMX to provide an extrudable bi-nitramine oxidizer-resin binder mixture that can be satisfactorily extruded in a manner not taught or suggested by the prior art.

The method of the invention results in a solid extruded propellant grain product that is characterized by a smooth surface and predicatable burn characteristics. The product is made from a composition of from 20% to 60% of a polyurethane binder matrix and from 40% to 80% of a binitramine oxidizer. Th oxidizer contains from 7.5% to 50% HMX, balance essentially RDX, all percentages being weight percent based upon total oxidizer-binder weight.

The invention also includes a method of producing the above discussed solid extruded propellant grain. The method includes solventlessly formulating an uncured propellant composition of from 20% to 60% of a polyurethane binder matrix and from 40% to 80% of a binitramine oxidizer. The oxidizer contains from 7.5% to 50% HMX, balance essentially RDX, all percentages being weight percent based upon total oxidizer-binder weight; and then extruding the uncured propellant composition to form a propellant grain characterized by a smooth surface and predictable burn characteristics.

The term "solventless method" means that the propellant was formulated without the use of a volatile processing aid solvent which does not participate in the cure reaction. Solvents that have been used in the past for propellant compositions similar to those of this invention include ketones such as acetone, petroleum ethers, methylene chloride, and amyl acetate. The solventless method of the invention is advantageous and that cost is lowered by not requiring the use of a solvent and the steps of adding and removing the solvent at a later stage of the process are eliminated.

DESCRIPTION OF THE INVENTION

Approximately 40 to 80 parts by weight of an oxidizer mixture containing HMX and RDX is mixed with a prepolymer diol, a curative for said prepolymer, and a crosslinker. The total mixture being 100 parts by weight. To this mixture is added an effective amount of a cure catalyst such as titanyl acetylacetonate. In practice, it has been found that 0.0125 parts of titanyl acetylacetonate provides an effective catalytic action. Larger quantities of this catalyst may be utilized, but they are not needed. Smaller quantities would also suffice. However, it is believed that a catalyst range of from 0.0050 to 0.0300 parts may be typically employed.

It is preferred, that a prepolymer diol be utilized. A preferred prepolymer is Pluronic L-35. Pluronic L-35 is a trademark of the Wyandotte Chemical Co. for a hydroxylterminated block copolymer of ethylene and propylene oxides. Other suitable diols include, but are not limited to, hydroxyterminated polybutadiene such as: R-45 (a trademark of Arco, Inc. for a hydroxyterminated polybutadiene); and R-18 (a Hooker Chemical, Inc. trademark for a diol). The preferred diols are highly fluid and readily wet the solid oxidizer, e.g. HMX/RDX, at process temperatures. Generally, it is desired that the diol be fluid between 80° and 135° F.

The curative agent for the aforesaid prepolymer preferably should be a diisocyanate. Isophorone diisocyanate (IPDI) is the preferred diisocyanate. Other diisocyanates which are suitable include toluene diisocyanate, hexane diisocyanate, and the like. Tri and polyfunctional isocyanates may also be used.

Because a thermoset composition is preferred, a crosslinker is utilized. A preferred crosslinker is a triol. The preferred triol is trimethylol propane, which is also known as TMP. Other suitable crosslinkers include, but are not limited to, ethylene oxide, glycidol, LHT 112 (a very fluid polyethylene glycol), polycaprolactone-260 (a trademark of Union Carbide for a waxy solid polycaprolactone) and like reactants.

In order to effectively cure the above composition, a cure catalyst is preferably utilized. A metal oxide cure catalyst such as titanyl acetylacetonate is preferred. Hereinafter, titanyl acetylacetonate will be symbolized as follows: $TiO(AA)_2$. Other cure catalysts include dibutyltindiacetate, dibutyltin dilauarate, ferric acetyl acetonate, and other reasonable catalysts.

The oxidizer component of the composition may range from 40% to 80%. However, it is preferred that the propellant mixture be approximately 70 to 80 weight percent oxidizer and approximately 20 to 30 percent binder, said weight percentages expressed as a percentage of total oxidizer-binder weight. More preferably, the oxidizer represents 73 to 78 weight percent of the propellant mixture. And, most preferably the propellent represents 75 to 78 weight percent of the propellant mixture. Because it is difficult to load the propellant with greater amounts of oxidizer without detrimentally affecting the viscosity characteristics of the propellent. Generally, about 75 weight perecent of oxidizer will be used because desirable performance characteristics of this propellant are obtained at such levels.

For the above propellants, it is preferable to have an NCO:diol:triol equivalent ratio of 110:15:85 since a propellant having high hardness is desired. Some variation from this ratio and from this hardness can be tolerated. A 5% variation within the ratio is reasonable and even an 8% or greater variation may be employed for each component within the ratio.

Although RDX and HMX generally may be utilized, it has been found that HMX and RDX having certain weight mean diameters tend to optimize the performance characteristics of said propellant RDX with a weight mean diameter of approximately 2.2 to 3.2 microns is preferred, and RDX with a weight mean diameter of approximately 2.7 microns is most preferred.

HMX having a weight mean diameter of 2.3 to 3.3 microns is preferred, and HMX having a weight mean diameter of approximately 2.8 microns is most preferred.

Plasticizers such as nitroglycerin and the like may be optionally included in the composition of the invention. However, metallic fuels such as aluminum should not be present in amounts of greater than about one percent of the combined oxidizer-binder weight of the propellant. Such maximum value is needed to prevent scoring of gun barrels when the gun propellants are employed.

In practice, the propellant composition is formulated and extruded through a die. A preferred die produces rope-like length of propellant having a central longitudinal perforation which, in turn has six axially arrayed perforations. Although this "7 perf" arrangement is preferred, other perforation arrays may be utilized to tailor the burning properties of the propellant.

When the propellant has been extruded, it is cut into sections. Although the length of a section is dictated by the particular purpose for which the propellant is to be utilized, it has been found that propellant sections of from ¼ to ¾ inches is preferred and a propellant section of approximately ½ inch most preferred. These propellant sections are heated in an oven at a temperature falling within the range of about 130° F. to 140° F.; and most preferably within a temperature range of 135° F. to 140° F. for a period of 96 hours.

It is noteworthy that the fluid energy-milled product of HMX has a different particle shape than RDX. Generally, as the amount of HMX increases relative to the amount of RDX, the more readily the uncured propellant mixture will extrude. Similarly, as the amount of HMX increases, feathering becomes less of a problem. A composition having at least 7.5 wt.% HMX avoids feathering and provides satisfactory extrusion parameters. An upper limit of about 50% HMX is contemplated due to cost considerations.

RDX typically contains from 2 to 10% HMX as impurity and HMX typically contains up to 2% RDX as impurity. Such percent impurities found in the RDX and HMX used in the following examples. The impurities do not significantly affect rheology and are not considered in determining the weight % of RDX or HMX for purposes of this invention. For example, if 90 grams of HMX and 10 grams of RDX are mixed together, the resultant mixture is 10% RDX and 90% HMX; regardless of the impurity content of each constituent.

EXAMPLE 1

The following compounds were utilized to form a propellant:

| | |
|---|---|
| Pluronic L-35 | 10.35 |
| Trimethylol Propane (TMP) | 2.76 |
| IPDI | 8.89 |
| RDX (2.7 micron) | 73.00 |
| HMX (2.8 micron) | 5.00 |
| | 100.00% |
| $TiO(AA)_2$ catalyst | 0.0125% |
| NCO:Diol:Triol | 110:15:85 |

A propellant was prepared from the above ingredients in the above designated weight relationships and in the following manner:

Pluronic L-35 and Trimethylol propane were mixed together and stirred for 10 minutes at 135° F. Without reducing the temperature, the RDX-HMX oxidizer mixture was added in four equal aliquots at ten minute intervals. IPDI and titanyl acetyl acetonate were added and the resultant mixture stirred for thirty minutes in a Baker Perkins mixing apparatus.

The resultant mixture was extruded through a 7 perf die apparatus. The die provided an opening sufficient to form an approximately ¼ inch diameter propellant grain which was cut into ½ inch lengths with a cutting device.

The extruded propellant was then heated in an oven at a temperature of 135° F. for a period of 96 hours, and allowed to cool.

The composition extruded with extreme difficulty; moreover, the propellant slumped closing the seven perforations. The composition contained 78 weight percent of combined nitramines.

EXAMPLE 2

Utilizing the method described in Example 1, the following compounds were mixed and utilized to form a propellant falling within this invention:

| | |
|---|---|
| Pluronic L-35 | 11.76 |
| Trimethylol Propane (TMP) | 3.14 |
| IPDI | 10.10 |
| RDX (2.7 micron) | 67.50 |
| HMX (2.8 micron) | 7.50 |
| | 100.00% |

-continued

| | |
|---|---|
| TiO $(AA)_2$ Catalyst | 0.0125% |
| NCO:Diol:Triol: | 110:15:85 |

The propellant thus formed was more viscous than the propellant of Example 1. However, when cured and heated, the seven perforations only closed slightly. All seven perforations were open after cure. This composition contained 75 weight percent of combined nitramines.

EXAMPLE 3

Utilizing the method described in Example 1, the following compounds were mixed and utilized to form a propellant falling within this invention:

| | |
|---|---|
| Pluronic L-35 | 11.76 |
| Trimethylol Propane (TMP) | 3.14 |
| IPDI | 10.10 |
| RDX (2.7 micron) | 45.00 |
| HMX (2.8 micron) | 30.00 |
| | 100.0% |
| TiO $(AA)_2$ Catalyst | 0.0125% |
| NCO:Diol:Triol: | 110:15:85 |

The propellant of Example 3 was even more viscous than the propellant of Example B. This propellant of Example C slumped very slightly and had well spaced and well rounded perforations. 75 weight percent of combined nitramines was utilized.

We claim:

1. A method of producing a solid extruded propellant grain characterized by a smooth surface and predictable burn characteristics, the method comprising:

a. solventlessly formulating an uncured propellant composition consisting essentially of from 20% to 60% based upon total oxidizer-binder weight of a plasticized or non-plasticized polyurethane binder matrix formed from (A) an isocyanante of functionality of at least 2, (B) a diol prepolymer which is a hydroxyl-terminated block copolymer of ethylene and propylene oxides and (C) a crosslinker, the matrix having an NCO:DIOL:crosslinker equivalent ratio of about 110:15:85, with about an 8% permissible variation in this ratio, and from 40% to 80% based upon total oxidizer-binder weight of a mixture of nitramine oxidizers consisting essentially of from 7.5 wt. % to 50 wt. % HMX based upon total oxidizer weight, balance essentially RDX, the amount of HMX being sufficient whereby feathering is avoided; and b. at a temperature whereat said prepolymer, said isocyanate and said crosslinker are in a liquid phase, extruding said uncured propellant composition to form a propellant grain.

2. The method of claim 1, which further comprises: segmenting said propellant grain; and curing said propellant grain.

3. The method of claim 2, wherein said mixture of nitramine oxidizers is present from 70% to 78% propellant.

4. The method of claim 3, wherein said mixture of nitramine oxidizers oxidizer is present from 73% to 78%.

5. A method according to claim 1 wherein said isocyanate is a diisocyanate selected from the group consisting of isophorone diisocyanate, toluene diisocyanate and hexane diisocyanate.

6. A method according to claim 1 wherein said crosslinker is selected from the group consisting of trimethylol propane, polyethylene glycidol and polycaprolactone.

* * * * *